US006648802B2

(12) United States Patent
Ware

(10) Patent No.: US 6,648,802 B2
(45) Date of Patent: Nov. 18, 2003

(54) VARIABLE PITCH STATIONARY EXERCISE BICYCLE

(76) Inventor: John Scott Ware, 600 Spirea Ct., Richmond, VA (US) 23236

( * ) Notice: Subject to any disclaimer, the term of this patent is extended or adjusted under 35 U.S.C. 154(b) by 342 days.

(21) Appl. No.: 09/753,778

(22) Filed: Jan. 2, 2001

(65) Prior Publication Data

US 2001/0031686 A1 Oct. 18, 2001

Related U.S. Application Data

(60) Provisional application No. 60/174,375, filed on Jan. 4, 2000.

(51) Int. Cl.[7] ..... A63B 69/16
(52) U.S. Cl. ..... 482/57; 482/64
(58) Field of Search ..... 482/5, 51, 57, 482/60–64, 114–116, 118–120, 148, 908

(56) References Cited

U.S. PATENT DOCUMENTS 5,035,418 A * 7/1991 Harabayashi ..... 482/62
5,549,527 A * 8/1996 Yu ..... 482/57
5,785,631 A * 7/1998 Heidecke ..... 482/5

* cited by examiner

*Primary Examiner*—Nicholas D. Lucchesi
*Assistant Examiner*—Tam Nguyen
(74) *Attorney, Agent, or Firm*—Jenkens & Gilchrist

(57) ABSTRACT

A stationary exercise bicycle having a frame; a base pivotally connected to said frame and having a front portion, a rear portion, and a side portion connecting said front portion to said rear portion; a pedaling mechanism connected to said frame; a flywheel in an operative relationship with said pedaling mechanism such that a rotation of said pedaling mechanism causes a rotation of said flywheel; and a tensioning member engaged with said flywheel and connected to said frame and said base such that said tensioning member exerts a tension on said pedaling mechanism, wherein said tension is reduced if said frame is tilted toward said front portion of said base and said tension is increased if said frame is tilted toward said rear portion of said base.

28 Claims, 3 Drawing Sheets

VARIABLE PITCH STATIONARY EXERCISE BICYCLE

RELATED APPLICATION

This is a complete application of U.S. patent application Ser. No. 60/174,375, filed Jan. 4, 2000.

BACKGROUND OF THE INVENTION

This invention relates to exercise equipment and, more specifically, to stationary exercise apparatus for simulating cycling on outdoor multi-grade terrain.

Stationary exercise bicycles are generally comprised of a rotary pedaling mechanism interactive with a flywheel, a seat, handlebar means, and means for controlling the amount of force required to operate the pedaling mechanism. The force controlling means is often a braking mechanism, which applies frictional force of an adjustable amount to either the sidewall of the flywheel or its circular perimeter edge. Electronic-type magnetic brake systems, employed in the more expensive exercise bicycles, require some form of external electric power supply.

The exercise person can generally control the intensity of the exercise session on such stationary bicycles by a) choosing the duration of the session, b) selecting the pedaling speeds, and c) adjusting the braking force applied to the flywheel. Although such exercise control options are satisfactory to many, those who enjoy actual outdoor cycling on hilly terrain, where the inclination or pitch of the bicycle changes from the horizontal plane, find the commonplace stationary exercise bicycle to be boring and unrealistic.

It is to be noted that in the case of treadmill exercise machines, a further control option is available for the exercise, namely, adjustment of inclination to represent hill climbing. Since such an adjustment inherently requires correspondingly increased exertion, no simulation or augmentation effect is required. In the case of a stationary bicycle, however, a tilting or inclining movement will not inherently produce changes in exertion levels.

Accordingly, it is a primary objective of the present invention to provide a stationary exercise device capable of simulating bicycle travel on a variable inclined terrain.

It is another object of the present invention to provide an exercise bicycle, as in the foregoing object, wherein the up and down direction and the magnitude thereof is controlled by the exerciser.

It is a further object of the present invention to provide an exercise bicycle of the aforesaid nature wherein the magnitude and direction of incline selected by the exerciser automatically adjusts the braking force according to the chosen up or downhill incline and the severity thereof.

These objects, and other objects and advantages of the present invention, will be apparent from the following description and the accompanying drawings.

SUMMARY OF THE INVENTION

A stationary exercise bicycle of the present invention comprises a frame and a base pivotally connected to the frame and has a front portion, a rear portion, and a side portion connecting the front portion to the rear portion. A pedaling mechanism is connected to the frame and is in an operative relationship with a flywheel, such that a rotation of the pedaling mechanism causes a rotation of the flywheel. A tensioning member is engaged with the flywheel and connected to the frame and the base in a manner such that the tensioning member exerts a tension on the pedaling mechanism. If the frame is tilted toward the front portion of the base, the tensioning member exerts a lesser tension on the pedaling mechanism, simulating downhill biking. If the frame is tilted toward the rear portion of the base, however, the tension is increased on the pedaling mechanism and the rider experiences the feeling of biking uphill. Thus, this invention allows a rider to increase and decrease the tension in the pedaling mechanism by tilting the bicycle.

In another embodiment, the tensioning member is attached to a knob on a guide plate on the frame. The knob can be slid along a length of the guide plate. Such movement changes the tension on the pedaling mechanism and allows the rider to experience different tension levels without having to tilt the bicycle.

BRIEF DESCRIPTION OF THE DRAWINGS

The foregoing and other advantages of the invention will become apparent upon reading the following detailed description and upon reference to the drawings, in which.

Figure 1:
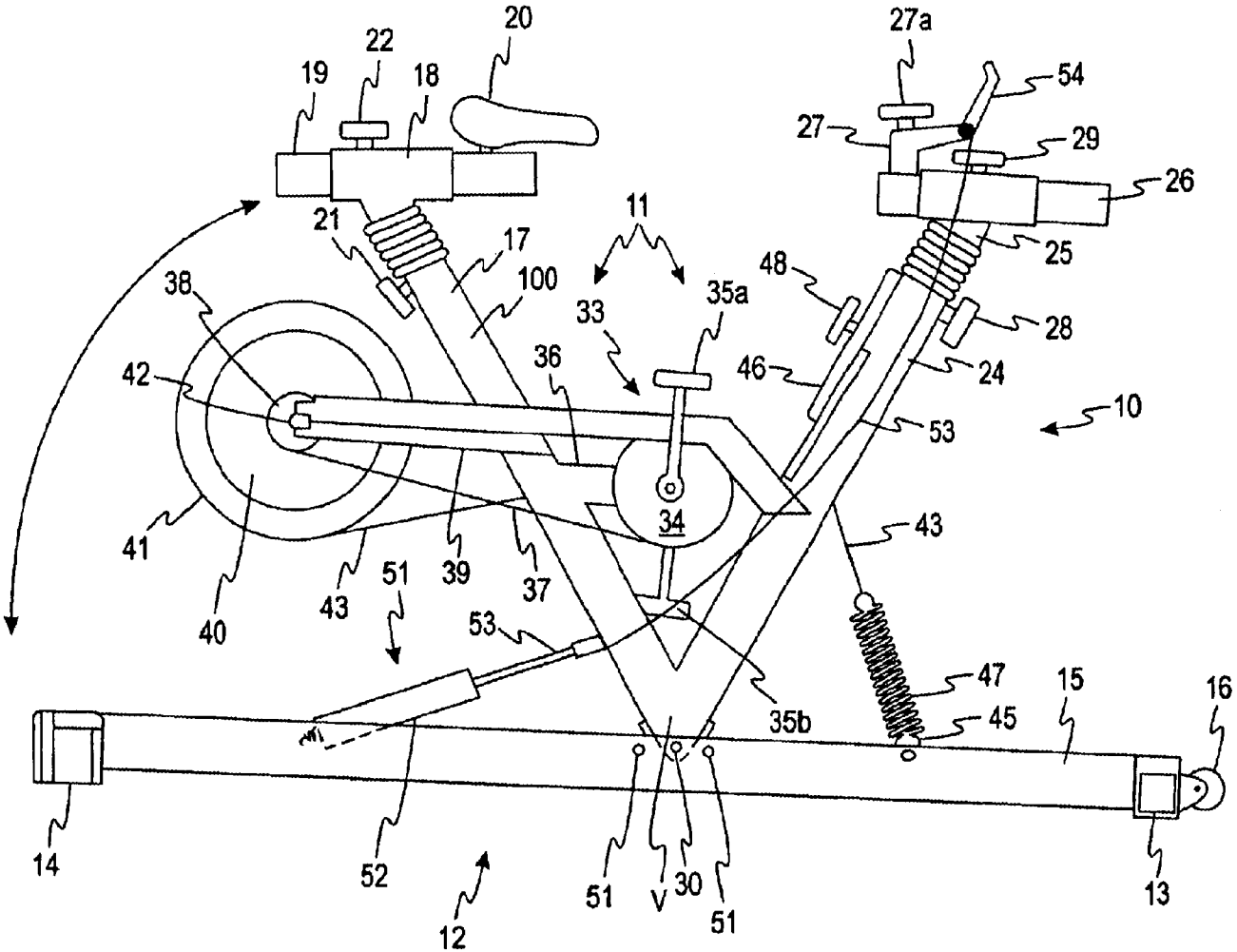
FIG. 1 is a side elevation of an exercise bicycle embodying the present invention.
Figure 4:
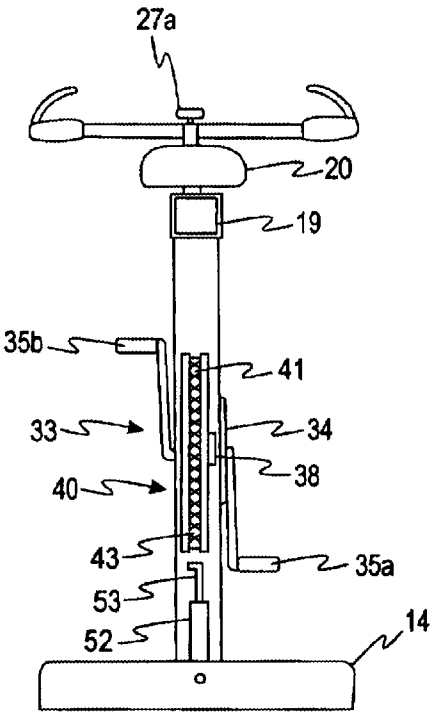
FIG. 4 is a rear end elevation of the bicycle in FIG. 1.
Figure 3:
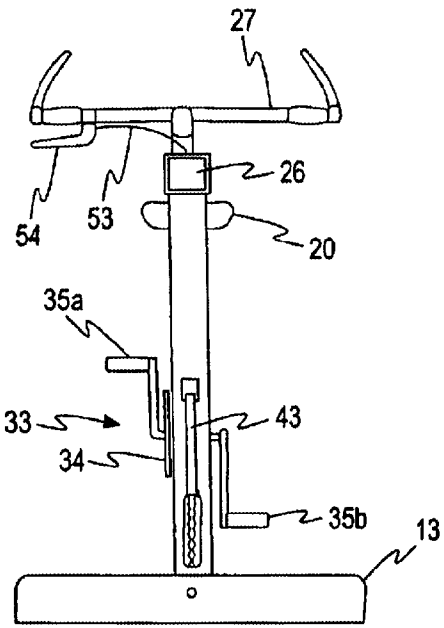
FIG. 3 is a front end elevation of the bicycle in FIG. 1.
Figure 2:
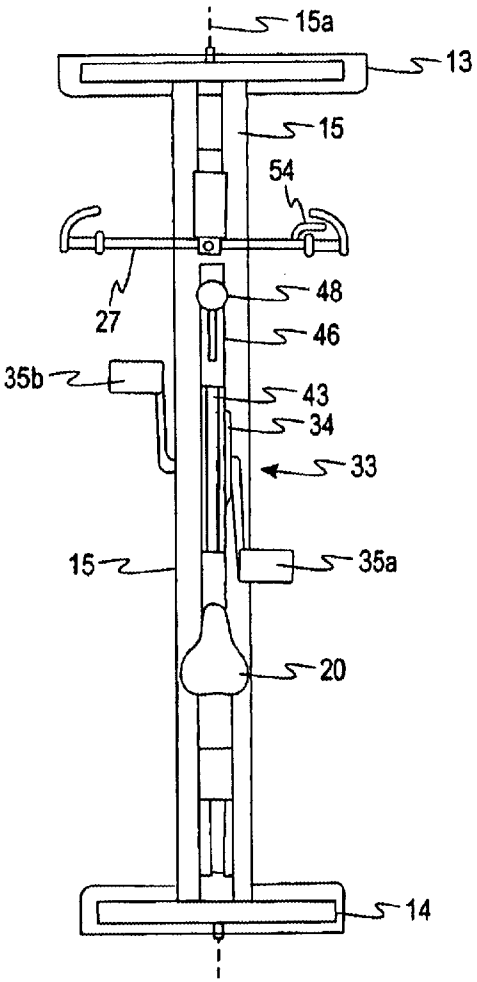
FIG. 2 is a top plan view of the bicycle in FIG. 1.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF ILLUSTRATIVE EMBODIMENTS

Referring now to FIGS. 1–4, a stationary exercise bicycle 10 includes a generally V-shaped frame 11 pivotally connected to a stationary base 12. In the illustrated embodiment, the base 12 has a rectangular configuration having front and rear transverse support bars 13 and 14, respectively, connected by a longitudinal bar 15 extending along a longitudinal axis 15*a* (shown in FIG. 2). As an alternative to the single longitudinal bar 15, a plurality of parallel bars may be utilized. Other embodiments of the base 12 may be non-rectangular but still characterized by having front, rear and longitudinal portions arranged along a longitudinal axis. The base is preferably of sturdy metal construction, although other sturdy materials, such as plastic or fiberglass, may be used. In one embodiment, the base is equipped with a plurality of wheels 16 (shown only in FIG. 1) to facilitate relocation of the exercise bicycle.

The V-shaped frame 11 includes a seat support member 17 that supports a seat 20 in a manner that permits both vertical and horizontal adjustments of the position of a seat 20. Thus, the support member 17 receives a telescoping shaft depending from a support member 18. The upper portion of the support member 18 in turn receives a horizontal telescoping bar 19 upon which a seat 20 is mounted. The shaft of the support member 18 and the horizontal bar 19 are locked and unlocked by means of screw-fitted knobs 21 and 22 threaded through the support members 17 and 18, respectively. When the knobs 21 and 22 are tightened, the shaft of the support member 18 and the horizontal bar 19, respectively, are locked into position. When the knobs are loosened, however, the shaft of the support member 18 and the horizontal bar 19 may be adjusted to fit the user's needs.

Figure 5:
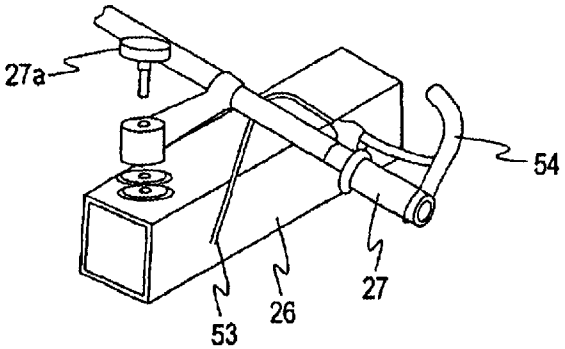
FIG. 5 is an exploded perspective of a portion of the handlebar subassembly in the bicycle in FIG. 1.

The frame 11 further includes a handlebar support member 24 that supports a handlebar assembly 27 (shown in FIG. 5) in a manner that permits both vertical and horizontal adjustments of the position the handlebars. Thus, the support member 24 receives a telescoping shaft depending from a support member 25. The upper portion of the support member 25 in turn receives a horizontal telescoping bar 26 upon which the handlebar assembly 27 is mounted. The shaft of the support member 25 and the horizontal bar 26 are locked and unlocked by means of screw-fitted knobs 28 and 29 threaded through the support members 24 and 25, respectively. When the knobs 28 and 29 are tightened, the shaft of the support member 25 and the horizontal bar 26, respectively, are locked into position. When the knobs are loosened, however, the shaft of the support member 25 and the horizontal bar 26 may be adjusted to fit the user's needs. The illustrative handlebar assembly 27 is a forward angled handlebar connected via bolt compression 27*a* to the horizontal sliding bar 26.

The two support members 17 and 24 are connected to form a vertex V containing a receiving aperture 30 to accept a pivot rod (bolt-not shown) 31 passing through the receiving aperture 30 and through receiving apertures positioned midway along the longitudinal bar 15 of the base 12 (shown in FIG. 8) By virtue of such manner of pivotal engagement, the frame 11 can be pivoted back and forth, relative to the stationary base 12, in an arcuate path vertically coplanar with the longitudinal axis of the base 12, as indicated by the arrowed arc in FIG. 1. If desired, the location of the pivotal connection between the frame 11 and the base 12 may be elevated above the principal horizontal plane of the base 12.

A pedaling mechanism 33 of conventional design is attached to the frame 11. The pedaling mechanism 33 includes a first drive sprocket 34 having two foot pedals 35*a*, 35*b* disposed on opposite sides in diametrically opposed relationship (shown in FIG. 4). The foot pedals 35*a* and 35*b* are arranged such that when one pedal 35*a* is rotated downward, the other pedal 35*b* rotates upward. The first drive sprocket 34 is located between the two support members 17 and 24, and is journaled to a pair of bifurcated support beams 36 which are welded to opposing sides of the support member 17 and, if desired, the support member 24. A drive chain 37 meshes with the drive sprocket 34 and extends rearwardly therefrom to mesh with a second drive sprocket 38. The second drive sprocket 38 is located beyond the support member 17, toward the rear of the base 12. Supporting the second drive sprocket 38 is a support arm 39 connected to the support member 17 and, if desired, the second support member 24.

A flywheel 40, having a circular perimeter edge 41 and center axle 42, is journaled by way of the axle 42 to the support arm 39 in a vertical orientation. The second drive sprocket 38 is also attached to the center axle 42, such that movement of the drive chain 37 produces rotation of the flywheel 40 in a vertical plane about the center axle 42.

An elongated compliant tensioning member 43 has a first extremity 44 and a second extremity 45. The first extremity 44 is threaded through and attached to the handlebar support tube 24 at a metal guide plate 46 (shown in FIG. 6). The elongated compliant tensioning member 43 may be a braking belt, a spring, a rope, or any other elongated compliant device currently known in the art. The second extremity 45 of the elongated compliant tensioning member 43 is then threaded through the metal guide plate 46, through the support tube 24, through the bifurcated support beam 36, around an idler roller (not shown) horizontally to the rear of the seat support member 17 and out through an access panel (not shown) on the seat support member 17. The elongated compliant tensioning member 43 is then threaded around the circular perimeter edge 41 of the flywheel 40, such that the elongated compliant tensioning member 43 is in frictional contact for approximately 300 degrees with the circular perimeter edge 41 of the flywheel 40, and back through the access panel on the seat support 17. The elongated compliant tensioning member 43 is then threaded through the bifurcated support 39 and forwardly through a forward-facing access panel (not shown) of the handlebar support member 24 The second extremity 45 of the elongated compliant tensioning member 43 is then attached to one end of a tensioning device (spring) 47 whose other end is attached to the longitudinal bar 15 of the base 12 forwardly of the vertex V of the frame 11.

Figure 6:
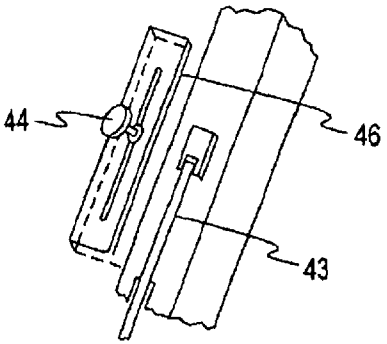
FIG. 6 is an exploded perspective of an alternative tensioning device for use in the bicycle in FIG. 1.

FIG. 6 illustrates a modified embodiment in which the metal guide plate 46 has a knob 48 attached to the first extremity 44 of the elongated compliant tensioning member 43. The knob 48 is slidable along the metal guide plate 46. By sliding the knob 48 along the plate 46, the user may increase or decrease the tension of the elongated compliant tensioning member 43. The stem of the knob 48 is threaded so that it can be tightened against the plate 46 to lock it in the desired position. It is also contemplated that instead of a metal guide plate 46 and a slidable knob 48, a spooling mechanism may be used such that the elongated compliant tensioning member 43 is wrapped around the spooling mechanism to increase tension, and then locked in position by a ratchet mechanism.

The path of the tensioning member 43 is such that when the frame 11 is pivoted forward and down around the axis of the bolt 30, the braking tension exerted upon the flywheel 40 is automatically diminished in proportion to the degree of downward inclination Such result simulates the ease of downhill bicycle travel.

Alternatively, when the rear of the frame 11, namely, the extremity holding the flywheel 40, is pivoted rearward and down around the axis of the bolt 30 to represent uphill travel, the elongated compliant tensioning member 43 automatically increases braking tension upon the flywheel 40 in proportion to the degree of inclination of the frame. Such result simulates the increased difficulty of uphill bicycle travel.

Figure 7:
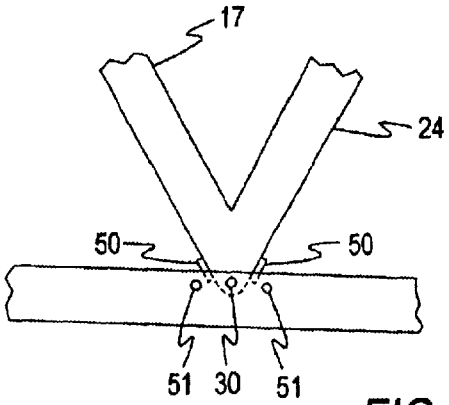
FIG. 7 is a detailed side elevation of the pivotal connection between the pivoting and stationary portions of the bicycle frame in the bicycle in FIG. 1.

Turning now to FIG. 7, forward and rearward restoring means 50, which may be in the form of rubber bumpers, are journaled near the vertex V of the two support members 17 and 24. Two range limitation rods 51 are inserted through apertures in the longitudinal bar 15 to position the rods 51 interactively on opposite sides of the frame pivot engagement point 30. The effect of the restoring means 50 is to offer assistance for returning the frame 11 to a neutral (horizontal) position.

A gas spring device 52 connected between the base 12 and the frame 11 is capable of undergoing changes in length when an actuator pin plunger is operated, and then maintaining the selected length. One suitable gas spring device for this application is the "BLOC-O-LIFT"® Rigid Locking Gas Spring available from Stabilus GmbH with offices in Gastonia, N.C. Changes in the length of the gas spring device 52 result in corresponding changes in the pitch or angle of inclination of the frame 11. A control cable 53 extends between the handlebar assembly 27 (shown in FIG. 5) and the gas spring device 52. The control cable 53 is connected to a cable actuator 54 at the handlebar assembly 27. When the cable actuator 54 is moved to a selected position, the effective length of the gas spring device is adjusted to a corresponding angle of inclination of the frame 11. When the cable actuator 54 is released, the length of the gas spring device 52 is locked, thereby securing the frame 11 in the selected angle of inclination.

In use, the rider or exerciser can pedal in a neutral or horizontal mode, and can make adjustments in braking tension by conventional methods. A conventional spooling mechanism that can be ratcheted to the desired tension will enable an exerciser to adjust the tension in a non-inclined position. When the user decides to change the pitch or uphill versus downhill status of the bicycle, he will actuate the positioning gas spring device 52 with the cable actuator 54 and shift his/her body weight fore or aft, thus producing a downhill or uphill pitch angle, respectively. Upon releasing the actuator 54, the pitch angle is locked. When it is desired to return to the neutral or horizontal pitch, the user merely activates the positioning gas spring device 52 again and repositions his/her body weight.

Figure 8:
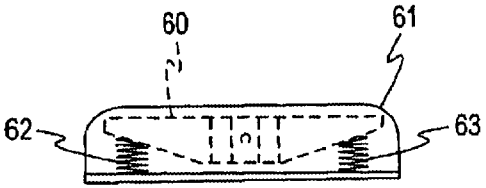
FIG. 8 is an end elevation of a modified transverse support member for use at opposite ends of the base of the bicycle.

FIG. 8 illustrates a modified transverse end support for use at both ends of the base of the exercise bicycle. In this modification, a transverse bar 60 is pivotally attached to one end of the longitudinal bar 15 and to a stationary housing 61 that rests on the floor. The free ends of the bar 60 are spaced above the bottom of the housing 61 and are supported by a pair of coil springs 62 and 63. This arrangement is repeated at the opposite end of the longitudinal bar 15. When the exerciser leans to one side, the bars 15 and 60 can tilt slightly, against the urging of the springs 62 and 63, which permits the bicycle to sway back and forth laterally. This swaying action further simulates the motion of a real bicycle being ridden over uneven terrain.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A stationary exercise bicycle comprising:

a base having a front portion, a rear portion, and a middle portion connecting said front portion to said rear portion;

a frame connected to said base, wherein said frame can pivot relative to said base;

a pedaling mechanism connected to said frame;

a flywheel in an operative relationship with said pedaling mechanism such that a rotation of said pedaling mechanism causes a rotation of said flywheel; and a tensioning member engaged with said flywheel and connected to said frame and said base such that said tensioning member exerts a tension on said pedaling mechanism, wherein said tension is reduced if said frame is tilted toward said front portion of said base and said tension is increased if said frame is tilted toward said rear portion of said base.

2. The stationary exercise bicycle according to claim 1, said flywheel having a circumference and said tensioning member in frictional engagement around approximately 250° to approximately 350° of said circumference of said flywheel.

3. The stationary exercise bicycle according to claim 2, said frame having a seat support member joined to a handlebar support member such that said seat support member is located at an acute angle relative to said rear portion of said base and said handlebar support member is located at an acute angle relative to said front portion of said base.

4. The stationary exercise bicycle according to claim 3, wherein said seat support member comprises a first support tube, a first shaft in engagement with said first support tube, a first horizontal bar in engagement with said first shaft, and a seat mounted on said first horizontal bar.

5. The stationary exercise bicycle according to claim 4, wherein said first shaft is substantially V-shaped.

6. The stationary exercise bicycle according to claim 4, wherein said first horizontal bar is in sliding engagement with said first shaft.

7. The stationary exercise bicycle according to claim 4, wherein said seat support member further comprises a screw fitted handle engaged to said first shaft such that when said screw fitted handle is rotated, said first shaft and said first horizontal bar may be moved relative to said first support tube.

8. The stationary exercise bicycle according to claim 4, wherein said handlebar support member comprises a second support tube, a second shaft in engagement with said second support tube, a second horizontal bar in engagement with said second shaft, and a handlebar mounted on said second horizontal bar.

9. The stationary exercise bicycle according to claim 8, wherein said second shaft is substantially V-shaped.

10. The stationary exercise bicycle according to claim 8, wherein said second horizontal bar is in sliding engagement with said second shaft.

11. The stationary exercise bicycle according to claim 8, wherein said handlebar is mounted on said second horizontal bar by a compression bolt such that said handlebar may rotate relative to said second horizontal bar.

12. The stationary exercise bicycle according to claim 8, wherein said tensioning member comprises a spring connected to said base, and a strap having a first end and a second end, wherein said first end of said strap is attached to a guide on said frame and said second end of said strap is attached to said spring.

13. The stationary exercise bicycle according to claim 12, wherein after said first end of said strap is attached to said guide, said second end of said strap is threaded through said frame, around said circumference of said flywheel, through said frame and attached to said spring.

14. The stationary exercise bicycle according to claim 3, further comprising a bifurcated support beam in engagement with said first and second support tubes, wherein said pedaling mechanism is joined to said bifurcated support beam.

15. The stationary exercise bicycle according to claim 3, said frame further having an extended support arm connected to said first and second support tubes, wherein said extended support arm is also connected to said flywheel by an axle.

16. The stationary exercise bicycle according to claim 3, said middle portion of said base comprising a first bolt nearer to said rear portion of said base and a second bolt nearer to said front portion of said base, and said seat support member having a first rubber pad and said handlebar support member having a second rubber pad, said first and second rubber pads and said first and second bolts arranged to prevent said frame from tilting past a predetermined angle.

17. The stationary exercise bicycle according to claim 3, said pedaling mechanism having a drive sprocket and said flywheel having a drive sprocket, wherein a chain is in engagement with said drive sprocket of said pedaling mechanism and said drive sprocket of said flywheel.

18. The stationary exercise bicycle according to claim 17, said pedaling mechanism further comprising a first pedal and a second pedal disposed on opposite sides of said pedaling mechanism, said first pedal and said second pedal in a diametrically opposed relationship, such that when said first pedal rotates downward, said second pedal rotates upward.

19. The stationary exercise bicycle according to claim 1, further comprising:

a positioning device in an operative relationship with said frame for adjusting and stabilizing the position of said frame with respect to pivotal movement.

20. The stationary exercise bicycle according to claim 19, wherein said device is a pneumatically-controlled positioning device.

21. The stationary exercise bicycle according to claim 20, wherein said pneumatically-controlled positioning device is connected to a control cable having a tension and joined to a cable actuator, such that activation of said cable actuator allows said frame to pivot in relation to said base.

22. The stationary exercise bicycle according to claim 1, further comprising at least one wheel attached to said front portion.

23. The stationary exercise bicycle according to claim 1, further comprising a spooling mechanism attached to said tensioning member wherein said tensioning member is wrapped around said spooling mechanism for changing said tension.

24. The stationary bicycle according to claim 23, said frame further comprising:

a first support tube;

a first V-shaped sliding shaft in sliding engagement with said first support tube;

a first horizontal bar in sliding engagement with said first V-shaped shaft;

a seat mounted on said first horizontal bar;

a second support tube connected to said first support tube;

a second V-shaped sliding shaft in sliding engagement with said second support tube;

a second horizontal bar in sliding engagement with said second V-shaped shaft;

a handlebar mounted on said second horizontal bar; and a bifurcated support member connecting said first support tube, said second support tube, and said pedaling mechanism.

25. The stationary exercise bicycle according to claim 23, wherein said tensioning member is a belt that comprises a first end and a second end, wherein said first end of said tensioning belt is attached to a metal guide on said frame and said second end is threaded through said frame, around approximately 300° of said circumference of said flywheel, through said frame and attached to a spring which is attached to said base.

26. The stationary exercise bicycle according to claim 23, further comprising a gas-spring device that is connected to a control cable having a tension and joined to a cable actuator, such that activation of said actuator allows said frame to pivot in relation to said base.

27. A stationary exercise bicycle comprising:

a base having a front portion, a rear portion, and a side portion connecting said front portion to said rear portion;

a frame having a seat support member having a first support tube, a first V-shaped sliding shaft in sliding engagement with said first support tube, a first horizontal bar in sliding engagement with said first V-shaped shaft, a seat mounted on said first horizontal bar, said frame further having a handlebar support member having a second support tube, a second V-shaped sliding shaft in sliding engagement with said second support tube, a second horizontal bar in sliding engagement with said second V-shaped shaft, and a handlebar mounted on said second horizontal bar, wherein said seat support member and said handlebar member are connected by a horizontal bar member;

a pivot bolt, connecting said frame to said base and allowing said frame to pivot relative to said base;

a pedaling mechanism having two diametrically opposed pedals such that when one of said two pedals rotates downward, the other of said two pedals rotates upward;

a flywheel having a drive sprocket, wherein said flywheel is connected to said frame by an extending support bar;

a chain in an operative relationship with said pedaling mechanism and said drive sprocket of said flywheel, such that a rotation of said pedaling mechanism causes a rotation of said drive sprocket of said flywheel;

a tensioning member attached to said handlebar member and in a frictional relationship with said flywheel, and having a tension when said frame is in a horizontal position, wherein said tension is increased when said frame is tilted relative to said base toward said rear portion of said base and said tension is decreased when said frame is tilted relative to said base toward said front portion of said base; and a gas spring device in an operative relationship with said handlebar support member and having a locking member for locking said frame in a position relative to said base.

28. A stationary bicycle comprising:

a base having a front bar, a rear bar, and at least one side bar connecting said front bar to said rear bar;

a frame in pivotal relationship with said base;

a pedaling mechanism connected to said frame;

a flywheel having a circumference and in an operative relationship with said pedaling mechanism such that a rotation of said pedaling mechanism causes a rotation of said flywheel, said flywheel connected to said frame by an extending support bar;

a tensioning belt in frictional engagement with said flywheel and connected to said frame and said base such that said tensioning member exerts a tension on said pedaling mechanism, wherein said tension is reduced if said frame is tilted toward said front portion of said base and said tension is increased if said frame is tilted toward said rear portion of said base; and a gas spring device in operative relationship with said frame and having a lever for locking said frame in a position relative to said base.

* * * * *